US005937768A

United States Patent [19]

Atwood

[11] Patent Number: 5,937,768

[45] Date of Patent: Aug. 17, 1999

[54] PORTABLE MULTI-PURPOSE OUTDOOR FIRE CONTAINER AND HOT WATER STORAGE SYSTEM

[76] Inventor: Alvin Dale Atwood, 2201 12th St. North, Apt. 3306, Cranbrook BC, Canada, V1C 5R9

[21] Appl. No.: 08/582,957

[22] Filed: Jan. 4, 1996

[51] Int. Cl.[6] ..... F23B 7/00

[52] U.S. Cl. ..... 110/234; 126/9 R; 126/513

[58] Field of Search ..... 122/353, 354, 122/286, 287, 288, 289; 126/513, 9 R; 110/234

[56] References Cited

U.S. PATENT DOCUMENTS

| | | | |
|---|---|---|---|
| 4,352,454 | 10/1982 | Ewing | 126/513 |
| 4,360,152 | 11/1982 | Schlatter et al. | 110/234 |
| 4,403,573 | 9/1983 | Cauchy | 110/234 |
| 4,461,242 | 7/1984 | Black | 126/513 |
| 4,495,860 | 1/1985 | Hitch et al. | 126/9 R |
| 4,524,751 | 6/1985 | Hoglund | 126/9 R |
| 4,751,897 | 6/1988 | Malhere et al. | 126/513 |
| 4,829,914 | 5/1989 | Boucher | 126/513 |
| 5,467,692 | 11/1995 | Perez, III | 126/9 R |

*Primary Examiner*—Henry A. Bennett
*Assistant Examiner*—Jiping Lu

[57] ABSTRACT

A portable multi-purpose outdoor fire container and hot water storage system comprising a first container of a cylindrical configuration with an open bottom surface and an open top surface with a cylindrical side wall therebetween is disclosed. The container has a grate supported by the opened top surface with the bottom surface capable of supporting firewood thereon. The container also has an air vent with handles in the side wall selectively openable in the sidewall at an intermediate extent thereof. A second hot water storage container in a box-like configuration is provided with rectangular sidewalls, a closed bottom and an open top with a lid positionable to close the open top. The hot water storage container is water impermeable for the storage of hot water therein. A water flow system comprises a first input pipe and a second output pipe, each pipe having one end coupled to a common wall of the hot water storage container for the movement of water between the pipes and the container, the pipes including a heat exchanger pipe within the lower region of the first container above the vent with brackets for holding the heat exchanger pipe in position for moving water from the input pipe to the output pipe by passage around the internal periphery of the first container.

4 Claims, 4 Drawing Sheets

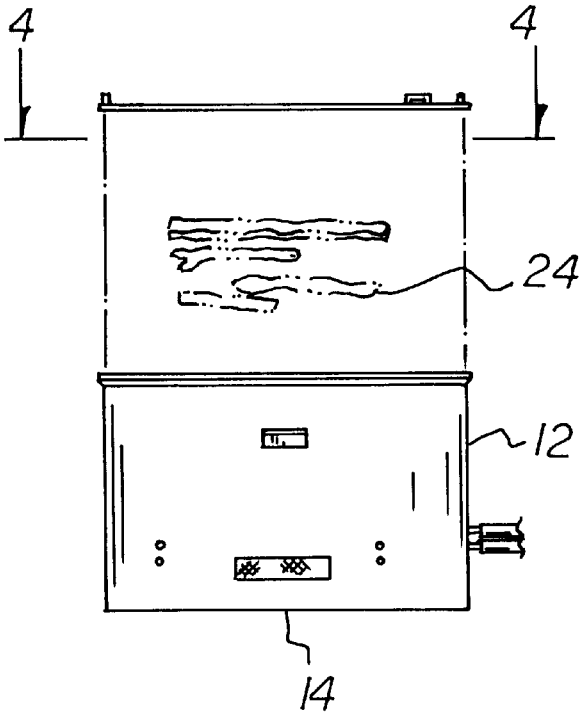
FIG. 3
FIG. 4
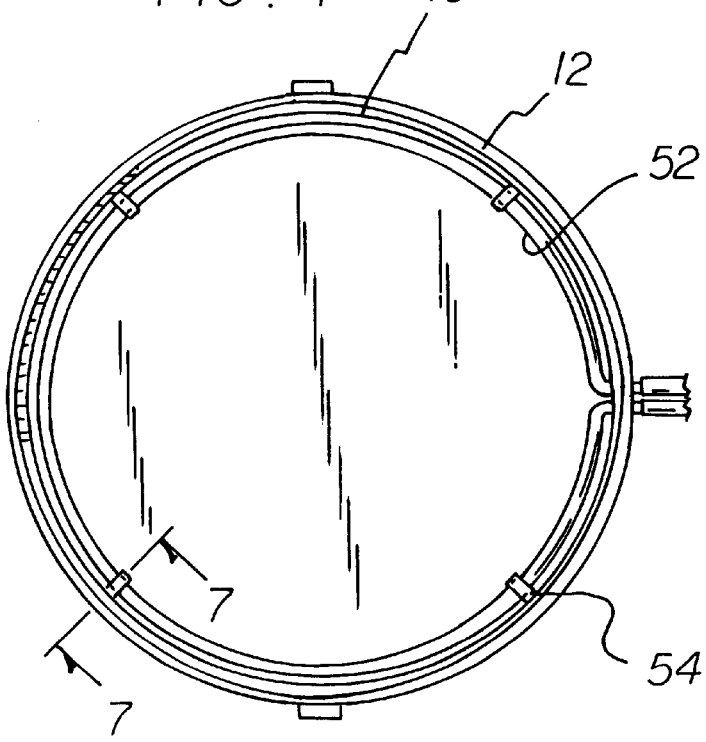

PORTABLE MULTI-PURPOSE OUTDOOR FIRE CONTAINER AND HOT WATER STORAGE SYSTEM

BACKGROUND OF THE INVENTION

1. Field of the Invention

The present invention relates to a portable multi-purpose outdoor fire container and hot water storage system and, more particularly, pertains to heating water and dispensing it as needed at an outdoor site with a fire.

2. Description of the Prior Art

The use of portable hot water heaters of a wide variety of designs and configurations is known in the prior art. More specifically, portable hot water heaters of a wide variety of designs and configurations heretofore devised and utilized for the purpose of heating water and dispensing it as needed through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,360,003 to Hardy a wood burning hot water heater.

U.S. Pat. No. 4,438,755 to Moffett discloses a wood burning stove having water heater.

U.S. Pat. No. 4,461,242 to Black discloses a means for heating water by wood burning.

U.S. Pat. No. 4,612,878 to Schnurer discloses a wood burning heater for circulating water.

U.S. Pat. No. Des. 268,951 to Ulmer discloses a wood burning water heater.

Lastly, U.S. Pat. No. Des. 271,709 to Snow, Jr. discloses a wood fueled water heater or the like.

In this respect, the portable multi-purpose outdoor fire container and hot water storage system according to the present invention substantially departs from the conventional concepts and designs of the prior art, and in so doing provides an apparatus primarily developed for the purpose of heating water and dispensing it as needed at an outdoor site with a fire.

Therefore, it can be appreciated that there exists a continuing need for a new and improved portable multi-purpose outdoor fire container and hot water storage system which can be used for heating water and dispensing it as needed at an outdoor site with a fire. In this regard, the present invention substantially fulfills this need.

SUMMARY OF THE INVENTION

In view of the foregoing disadvantages inherent in the known types of portable hot water heaters of a wide variety of designs and configurations now present in the prior art, the present invention provides an improved portable multi-purpose outdoor fire container and hot water storage system. As such, the general purpose of the present invention, which will be described subsequently in greater detail, is to provide a new and improved portable multi-purpose outdoor fire container and hot water storage system and method which has all the advantages of the prior art and none of the disadvantages.

To attain this, the present invention essentially comprises a new and improved portable multi-purpose outdoor fire container and hot water storage system comprising, in combination, a first container of a cylindrical configuration having an open bottom surface and an open top surface with a cylindrical side wall therebetween, the container having a grate supported by the opened top surface with the bottom surface capable of supporting firewood thereon, the container having an air vent with handles in the side wall selectively openable in the sidewall at an intermediate extent thereof; a second hot water storage container in a box-like configuration having rectangular sidewalls, an open bottom and an open top with a lid positionable to close the open top, the hot water storage container being water impermeable for the storage of hot water therein; a water flow system comprising a first input pipe and a second output pipe, each pipe having one end coupled to a common wall of the hot water storage container for the movement of water between the pipes and the container, the pipes including a heat exchanger pipe within the lower region of the first container above the vent with brackets for holding the heat exchanger pipe in position for moving water from the input pipe to the output pipe by passage around the internal periphery of the first container, the water flow system including a squeezable ball-like water primer in the input line to initiate the flow of water from the first container to the second container; a tap operatively coupled to a wall in the storage container opposite from the pipes for the selective dispensing of water from the storage container; and the grate being formed with an open section and imperforate section and with a pivot pin coupling the sections.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable multi-purpose outdoor fire container and hot water storage system which has all the advantages of the prior art portable hot water heaters of a wide variety of designs and configurations and none of the disadvantages.

It is another object of the present invention to provide a new and improved portable multi-purpose outdoor fire container and hot water storage system which may be easily and efficiently manufactured and marketed.

It is a further object of the present invention to provide a new and improved portable multi-purpose outdoor fire container and hot water storage system which is of a durable and reliable construction.

An even further object of the present invention is to provide a new and improved portable multi-purpose outdoor fire container and hot water storage system which is susceptible of a low cost of manufacture with regard to both materials and labor, and which accordingly is then susceptible of low prices of sale to the consuming public, thereby making such portable hot water heaters of a wide variety of designs and configurations economically available to the buying public.

Still yet another object of the present invention is to provide a new and improved portable multi-purpose outdoor fire container and hot water storage system which provides in the apparatuses and methods of the prior art some of the advantages thereof, while simultaneously overcoming some of the disadvantages normally associated therewith.

Even still another object of the present invention is to heating water and dispensing it as needed at an outdoor site with a fire.

Lastly, it is an object of the present invention to provide a portable multi-purpose outdoor fire container and hot water storage system comprising a first container of a cylindrical configuration with an open bottom surface and an open top surface with a cylindrical side wall therebetween. The container has a grate supported by the opened top surface with the bottom surface capable of supporting firewood thereon. The container also has an air vent with handles in the side wall selectively openable in the sidewall at an intermediate extent thereof. A second hot water storage container in a box-like configuration is provided with rectangular sidewalls, a closed bottom and an open top with a lid positionable to close the open top. The hot water storage container is water impermeable for the storage of hot water therein. A water flow system comprises a first input pipe and a second output pipe, each pipe having one end coupled to a common wall of the hot water storage container for the movement of water between the pipes and the container, the pipes including a heat exchanger pipe within the lower region of the first container above the vent with brackets for holding the heat exchanger pipe in position for moving water from the input pipe to the output pipe by passage around the internal periphery of the first container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an elevational view thereof.

FIG. 4 is an open top view thereof.

The same reference numerals refer to the same parts throughout the various Figures.

DESCRIPTION OF THE PREFERRED EMBODIMENT

Figure 1:
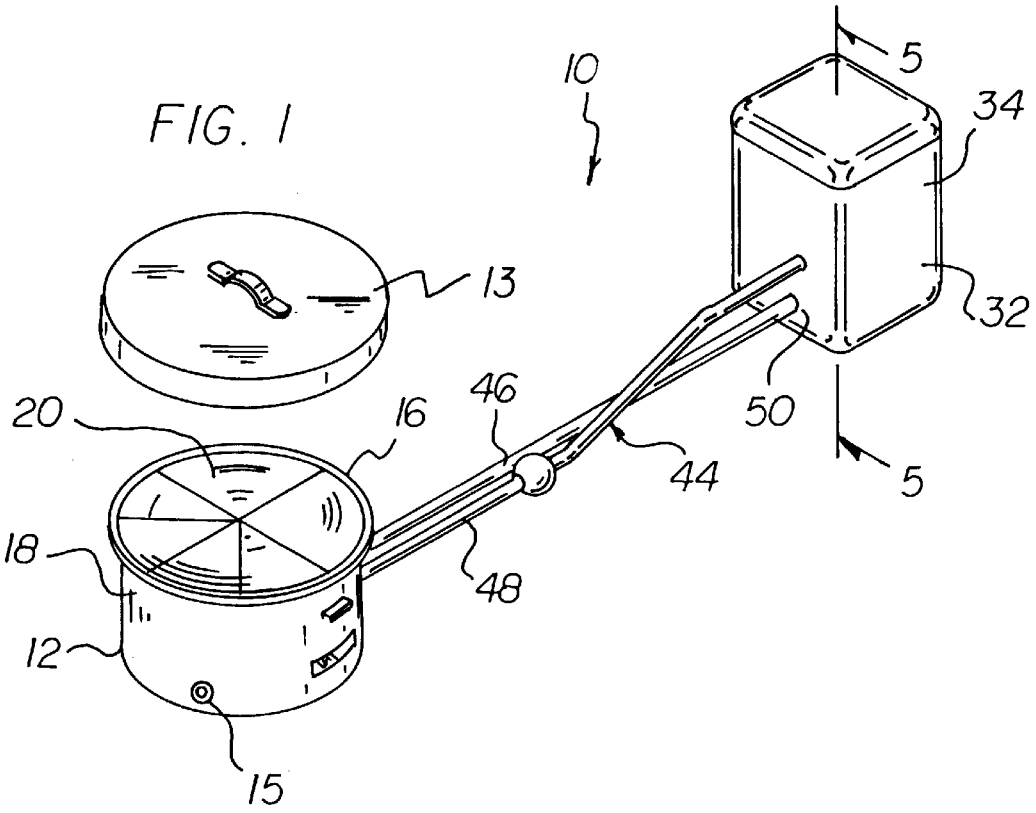
FIG. 1 is a perspective illustration of the preferred embodiment of the portable multi-purpose outdoor fire container and hot water storage system constructed in accordance with the principles of the present invention.
Figure 2:
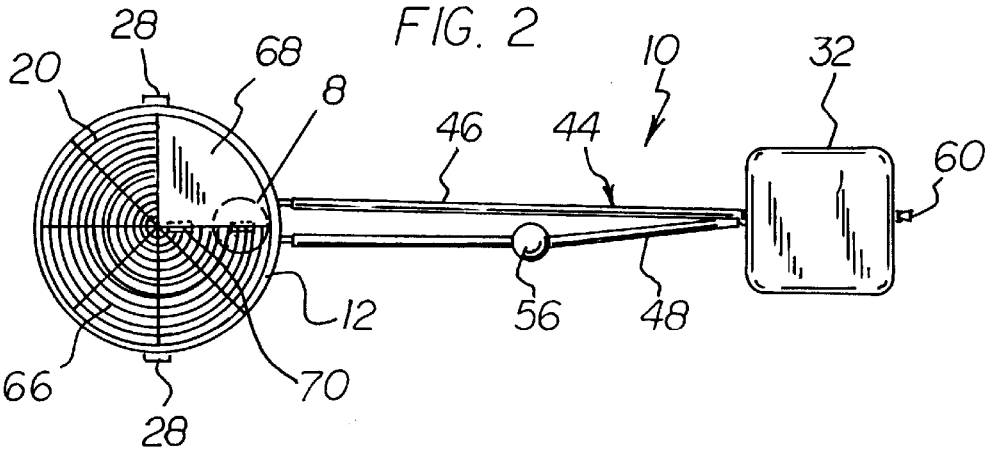
FIG. 2 is a top view thereof.
Figure 5:
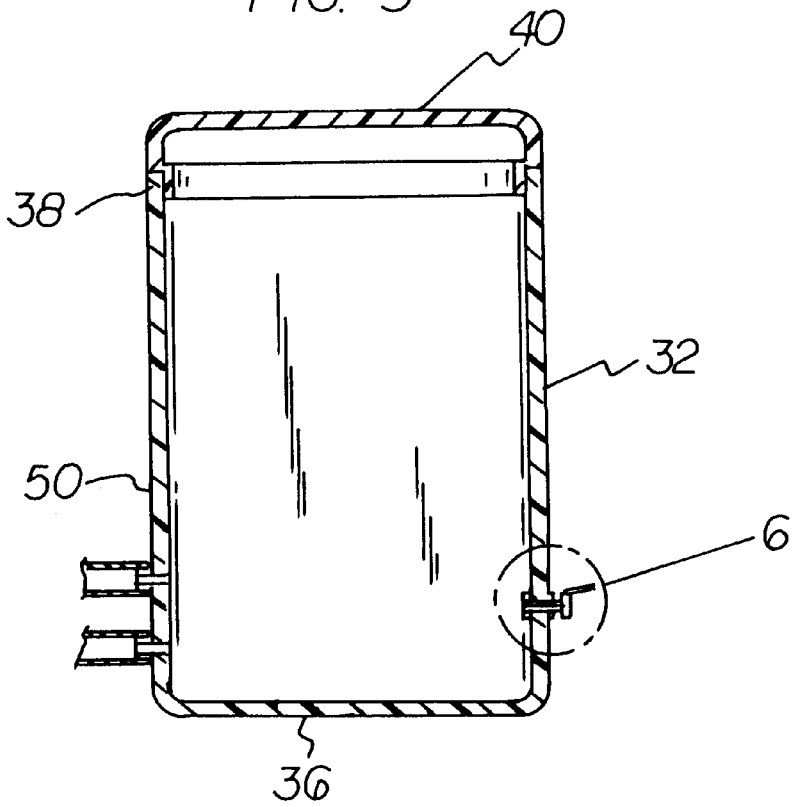
FIG. 5 is a sectional view thereof.
Figure 6:
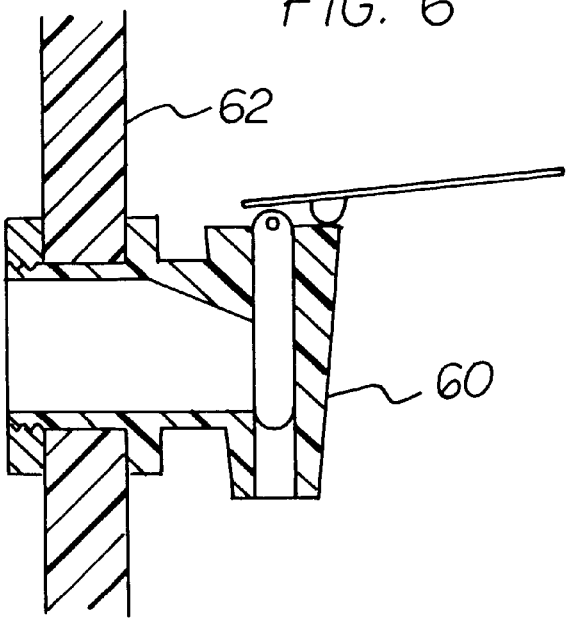
FIG. 6 is an enlarged sectional view as indicated in FIG. 5.
Figure 7:
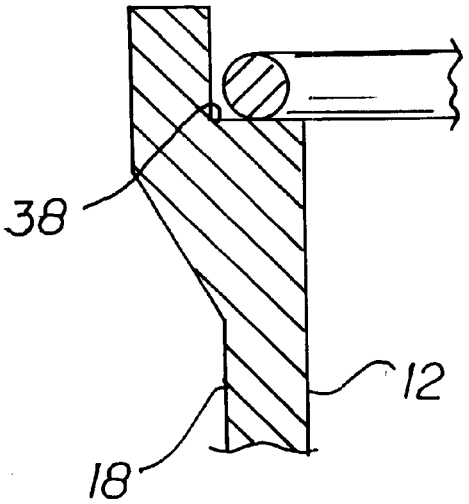
FIG. 7 is an enlarged sectional view showing the grate and heating pipe.
Figure 8:
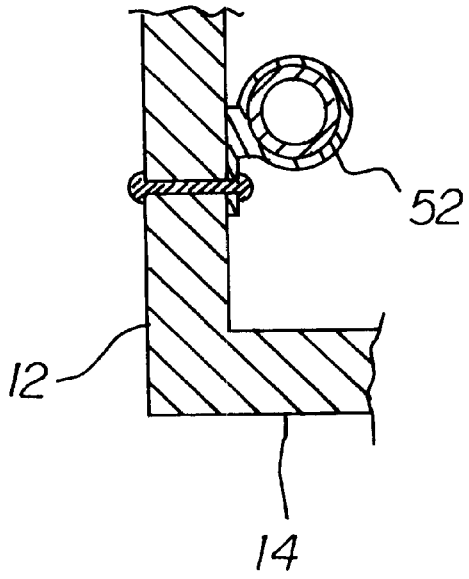
FIG. 8 is an enlarged plan view as indicated in FIG. 2.
Figure 8:
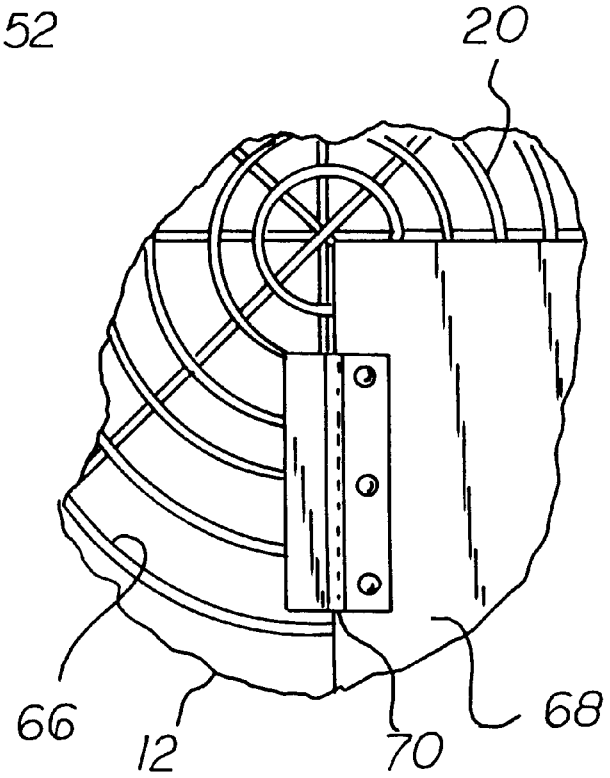

With reference now to the drawings, and in particular to FIG. 1 thereof, the preferred embodiment of the new and improved portable multi-purpose outdoor fire container and hot water storage system embodying the principles and concepts of the present invention and generally designated by the reference numeral 10 will be described.

The present invention, the new and improved portable multi-purpose outdoor fire container and hot water storage system, may be considered as being fabricated of a plurality of components designed and configured for functioning together in a system-like configuration. In their broadest context, the components include a first container for supporting a fire, a second hot water storage container, a water flow system, and a tap. Each of the individual components is specifically configured and correlated one with respect to the other so as to attain the desired objectives.

More specifically, the system 10 of the present invention includes as a primary component a first container 12. Such first container is a fire container and is formed of a cylindrical configuration. It has an open bottom surface 14. It also has an open top surface 16. Cylindrical side walls 18 are coupled between the bottom surface and top surface. A smoker oven/fire pit cover 13 is preferably provided. In addition, an alternative fuel adapter 15 is also preferably provided.

In association with the first container is a grate 20. The grate is supported by the open top surface. The bottom surface is capable of supporting firewood thereon for generating a fire within the first container. Formed in association with the first container is an air inlet vent 26. Such vent is selectively closeable and openable in the side wall beneath an intermediate extent. In association with the side walls are also formed handles 28.

The next major component of the system 10 is a second hot water container 32. Such container is in a box-like configuration. It has rectangular side walls 34. It also has a closed bottom 36 and an open top 38. A lid 40 is positionable above the open top whereat it is supported. The lid is adapted to close the open top. The lid fits on top of the fire pit and has many functions such as adapting the present invention to function as a baker oven or a smoker or the like and also to control the fire and heat as well as to smother the fire, the later two functions being the most important. The hot water storage container is fabricated of a water impermeable material for the storage of hot water therein and the heating thereon.

Coupling the first and second containers is a water flow system 44. Such system comprises a first input pipe 46 and a second output pipe 48. Each of the pipe has one end coupled to a common wall 50 of the hot water storage container. This allows for the movement of water between the pipes and the container.

The pipes also include a heat exchanger pipe 52. Such heat exchanger pipe is located within the lower region of the first container above the vent. The coiled heat exchanger is in the fire pit and is horizontal in the preferred embodiment but may also be placed in a vertical position as would be obvious to one skilled in the art. It has associated brackets 54 which function for holding the heat exchanger pipe in proper position for receiving heat from the fire and passing it to the water. It is also located for moving water from the input pipe to the output pipe. This is done by passage of the water around the internal periphery of the first container.

In association with the pipes as part of the pipe water flow system is a squeezable ball-like water primer 56. This primer is located in the input line. It functions to initiate the flow of water from the first container to the second container when the ball is repeatedly squeezed and released in a priming function.

Next provided is a tap 60. The tap is operatively coupled to a wall 62 in the storage container opposite from the pipes. The tap functions for selectively dispensing water from the storage container for use by an operator of the system. Lastly provided is a grate 20. The grate is formed with an open section formed of wires in concentric rings and radially extending coupling wires. In association therewith is an imperforate section 68. A pivot pin 70 couples the imperforate section with the open section to allow access to the fire for adding additional wood thereto.

The present invention comprises a portable cylinder for containing a fire that can be used outdoors to cook food and heat water at the same time. The present invention is less cumbersome and more efficient than external coil arrangements. The container and lid make the fire easy to control and smother.

The major component of the present invention is a solid steel cylinder 17 inches high with a diameter of 26 inches which includes a lid. The lower half of the cylinder is equipped with two air vents and two handles. A copper coil runs along the inner circumference of the fire compartment. The coil is attached to a pair of rubber heat-resistant hoses, one with a primer pump, approximately six to eight inches long. A square plastic five-gallon container with a spigot holds the water. The upper half of the cylinder is hollow and covered with a metal grate, on-quarter of which is solid and hinged on one side.

To operate, the cylinder is placed in an outdoor fire pit or location. The hoses, inlet and outlet, are attached to the fire and water containers. The user fills the water container with water. Air is bled from the inlet line with the primer pump. The user starts a fire in the lower compartment of the cylinder. When the fire is ready, food can be placed on the grill to cook. When water in the coil becomes hot, it circulates through the hoses, into the water container and can be dispensed through the spigot. When the fire is not in use, the fire can be smothered with the lid.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable multi-purpose outdoor fire container and hot water storage system comprising:

a first container of a cylindrical configuration having bottom surface and an open top surface with a cylindrical side wall therebetween, the container having a grate supported by the opened top surface, the bottom surface of the first container capable of supporting firewood thereon, the container having an air vent with handles in the side wall selectively openable in the sidewall at an intermediate extent thereof;

a second hot water storage container in a box-like configuration having rectangular sidewalls, a closed bottom and an open top with a lid positionable to close the open top, the hot water storage container being water impermeable for the storage of hot water therein; and a water flow system comprising a first input pipe and a second output pipe, each pipe having one end coupled to a common wall of the hot water storage container for the movement of water between the pipes and the container, the pipes including a heat exchanger pipe within the lower region of the first container above the vent with brackets for holding the heat exchanger pipe in position for moving water from the input pipe to the output pipe by passage around the internal periphery of the first container and wherein the grate is formed with an open section and an imperforate section with a pivot pin coupling the sections.

2. The system as set forth in claim 1 wherein the water flow system includes a squeezable ball-like water primer in the input line to initiate the flow of water from the first container to the second container.

3. The system as set forth in claim 1 and further including a tap operatively coupled to a wall in the storage container opposite from the pipes for the selective dispensing of water from the storage container.

4. A portable multi-purpose outdoor fire container and hot water storage system comprising, in combination:

a first container of a cylindrical configuration having bottom surface and an open top surface with a cylindrical side wall therebetween, the container having a grate supported by the opened top surface, the bottom surface of the first container capable of supporting firewood thereon, the container having an air vent with handles in the side wall selectively openable in the sidewall at an intermediate extent thereof;

a second hot water storage container in a box-like configuration having rectangular sidewalls, a closed bottom and an open top with a lid positionable to close the open top, the hot water storage container being water impermeable for the storage of hot water therein;

a water flow system comprising a first input pipe and a second output pipe, each pipe having one end coupled to a common wall of the hot water storage container for the movement of water between the pipes and the container, the pipes including a heat exchanger pipe within the lower region of the first container above the vent with brackets for holding the heat exchanger pipe in position for moving water from the input pipe to the output pipe by passage around the internal periphery of the first container, the water flow system including a squeezable ball-like water primer in the input line to initiate the flow of water from the first container to the second container;

a tap operatively coupled to a wall in the storage container opposite from the pipes for the selective dispensing of water from the storage container; and the grate being formed with an open section and imperforate section and with a pivot pin coupling the sections.

* * * * *